United States Patent [19]

Tuma

[11] Patent Number: 5,000,075

[45] Date of Patent: Mar. 19, 1991

[54] DOUBLE ACTION PISTOL

[75] Inventor: Martin Tuma, Solothurn, Switzerland

[73] Assignees: ITM Industrial Technology & Machines AG; Sphinxwerke Muller AG, both of Solothurn, Switzerland

[21] Appl. No.: 460,768

[22] Filed: Jan. 4, 1990

[51] Int. Cl.[5] ..... F41A 19/51

[52] U.S. Cl. ..... 89/147

[58] Field of Search ..... 42/65, 66; 89/147

[56] References Cited

U.S. PATENT DOCUMENTS 2,138,213 11/1938 Seidel ..... 89/147

FOREIGN PATENT DOCUMENTS 69618 7/1949 Denmark ..... 89/147

13880 of 1908 United Kingdom ..... 89/147

*Primary Examiner*—Stephen C. Bentley

*Attorney, Agent, or Firm*—Ladas & Parry

[57] ABSTRACT

A rotatably mounted hammer lock member has a hammer stop abutment. The trigger rod has a first operating projection received in a recess of the hammer lock member such that a reciprocal movement of the trigger rod causes a corresponding rotational movement of the hammer lock member. An interrupter member is hingedly mounted to the hammer. A projection at the rear end of the trigger rod is loosely received in a recess of this interrupter member. The rear end of the trigger rod includes a chamfered control surface area. The frame of the gun includes a corresponding chamfered control surface area. When the trigger rod is moved by the trigger for firing the gun, it rotates the hammer lock member such that its hammer stop abutment will be moved out of the way of the hammer.

1 Claim, 2 Drawing Sheets

Fig. 2
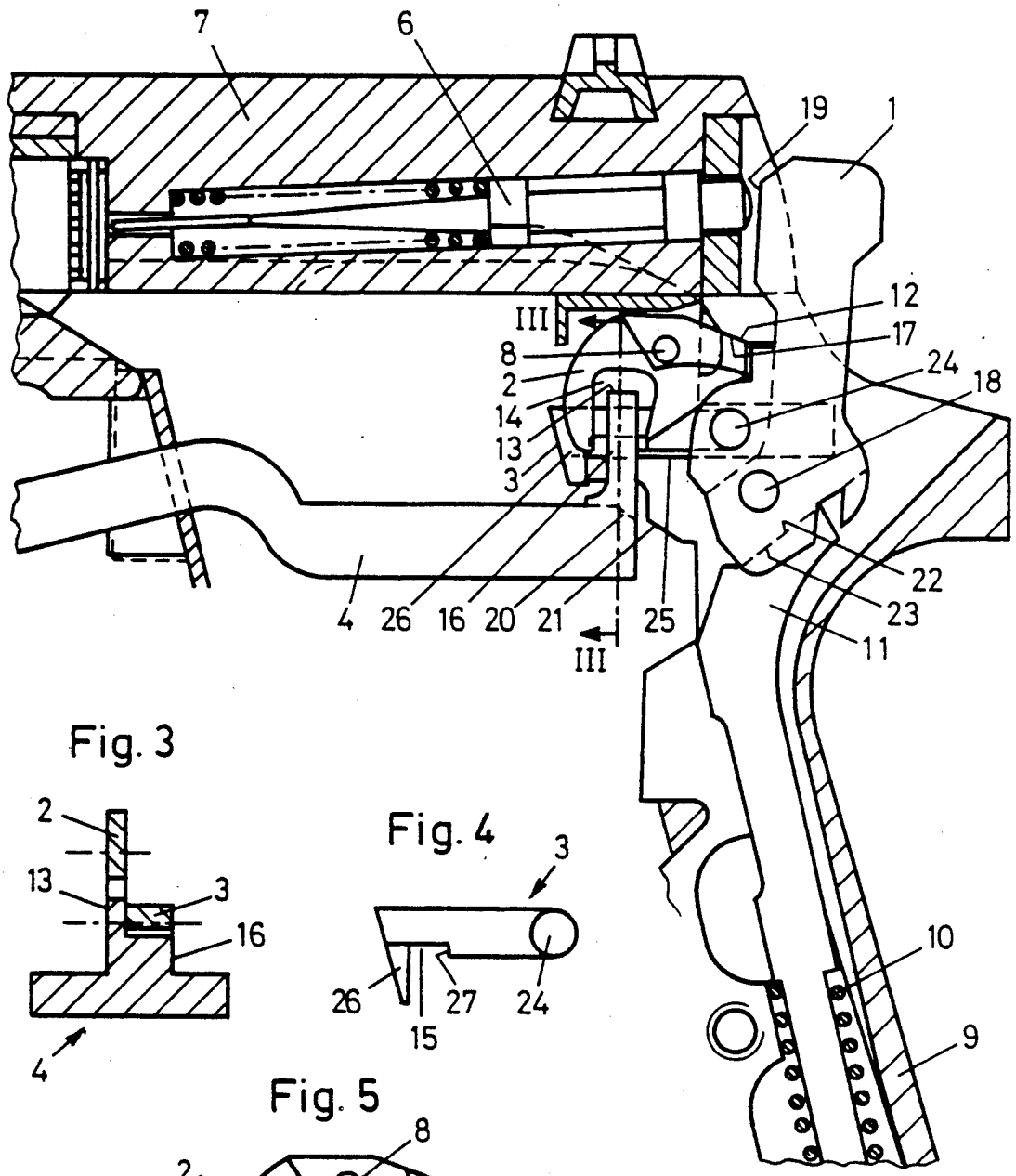
Fig. 3
Fig. 4
Fig. 5
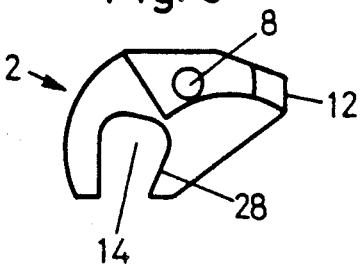

DOUBLE ACTION PISTOL

BACKGROUND OF THE INVENTION

1. Field of the Invention

The present invention relates to a double action pistol including a slide, a frame, a firing pin, a hammer, a trigger rod and a trigger pivotably mounted thereto, and including a means for decocking and locking the hammer.

2. Description of the Prior Art

Generally known pistols include a mechanism for a manual releasing of the safety catch of the firearm. The operation of the safety catch is of specific importance if such pistol is carried in a loaded condition, ie when a round is loaded in the chamber. It is now generally known that specifically in such case a possible manual releasing of the safety catch of the gun can lead to a failing of the person having to fire the gun specifically if such person is in a stress situation.

SUMMARY OF THE INVENTION

It is, therefore, a general object of the invention to provide a double action pistol having no separately operable safety catch operating member, and does not need a special decocking arm for a decocking of the hammer after a loading movement, and which pistol functions to fire merely upon the operating of the trigger mechanism.

A further object of the present invention is to provide a double action pistol of which the hammer decocking and locking means include a rotatably mounted hammer lock member having a hammer stop abutment, which hammer lock member is rotatable between a hammer locking and a hammer release position, and the trigger rod having a first operating projection received in a recess of the hammer lock member; and having further an interrupter member pivotably mounted to the hammer and having a recess in which a second operating projection of the trigger rod is received; whereby a trigger-caused translatory movement of the trigger rod is transformed into a rotary movement of the hammer lock member and simultaneously transmitted by the interrupter member to the hammer such to be transformed into a pivoting movement thereof.

BRIEF DESCRIPTION OF THE DRAWING

The invention will be better understood and objects other than those set forth above will become apparent when consideration is given to the following detailed description thereof. Such description makes reference to the annexed drawings, wherein:

FIG. 2 is a sectional view, on an enlarged scale of the rear part of the pistol illustrated in FIG. 1;

FIG. 3 is a sectional view along line III—III of FIG. 2;

FIG. 4 is a side view of an interrupter member; and

FIG. 5 is a side view of a hammer lock member.

DESCRIPTION OF THE PREFERRED EMBODIMENT

Figure 1:
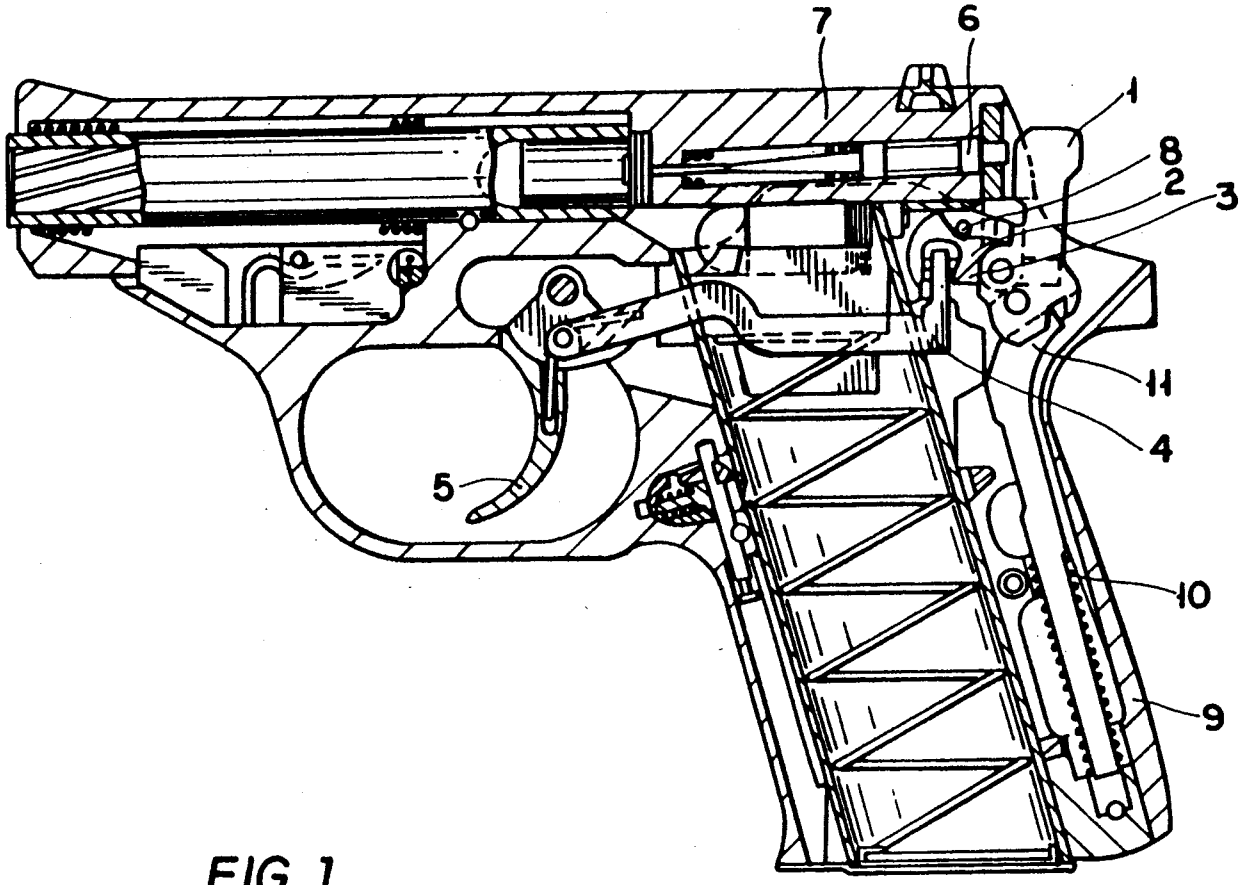
FIG. 1 is a sectional view of a pistol incorporating the present invention.

The cross-sectional view of the pistol illustrated in FIG. 1 is so far merely for the purpose of illustrating a present preferred embodiment of the invention. Accordingly, only those structural members are identified by reference numerals which are necessary for understanding the present invention. The other important parts of this pistol are generally known to the person skilled in the art. FIG. 2 illustrates on an enlarged scale a section through the same pistol as illustrated in FIG. 1, whereby however more parts or structural units, respectively, of the embodiment of the invention are shown.

The pistol includes a hammer 1, pivotably supported by a pin 18 defining the pivot axis of the hammer at the frame 9 of the gun. This allows the well-known pivoting, ie cocking and decocking movement of the hammer 1. The gun is equipped with the trigger 5 that is pivotably mounted on the one hand to the frame 9 and on the other hand to the trigger rod 4. The trigger rod 4 extends from the trigger 5 back towards the general area of the hammer 1 of the pistol. At its rear end, the trigger rod 4 is designed with a first projection 13 and an adjacently located second projection 16, which projections are designed in the sectional view of FIG. 3. The first projection 13 is taller than the second projection 16. The first, taller projection 13 extends into a recess 14 of a hammer lock member 2, sometimes termed sear, which hammer lock member 2 is illustrated separately in FIG. 5. The hammer lock member 2 is supported on a pin 8, mounted in turn in the frame 9. Accordingly, this pin 8 defines a rotation axis of the hammer lock member 2. The hammer lock member 2 includes furthermore a hammer stop abutment 12. When considering in FIG. 2 only the trigger rod 4 and its operating projection 13 extending into the recess 14 of the hammer lock member 2, it is obvious that a translatory movement of the trigger rod 4, specifically to the right-hand side of FIG. 2, will cause the hammer lock member 2 to rotate counter-clockwise around pin 8 such that the hammer stop abutment 12 makes a corresponding circular movement around the pin 8.

Somewhat adjacent the hammer lock member 2 an interrupter member 3 is located. This interrupter member 3, which is illustrated best in FIG. 4, is pivotably mounted to the hammer 1 via a pin 24 illustrated in FIGS. 2 and 4.

The second, lower operating projection 16 of the trigger rod 4 projects into a recess 15 of the interrupter member 3. Accordingly, a translatory movement of the trigger rod 4 will cause a translatory movement of this interrupter member 3 which, since it is pivotably mounted via the pin 24 to the hammer 1 will cause a pivoting, ie cocking and decocking, respectively, movement of the hammer 1 around its pin 18. The frame 9 includes a support 25, see FIG. 2, for this interrupter member 3, preventing it from pivoting downwards (anti-clockwise around pin 24) in case of the second operating projection 16 of the trigger rod 4 moving away out of the recess 15.

At its rear end that includes the two operating projections 13 and 16, the trigger rod 4 has a chamfered control surface area 20. The frame 9 has a further chamfered control surface area 21 which is aligned with the first named control surface area. If, as will be explained lateron more in detail, the rear end of the trigger rod 4 glides due to its control surface area 20 along and downward the chamfered control surface area 21 of the frame 9, the second operating projection 16 of this trigger rod 4 can indeed move completely out of the recess 15 of the interrupter member 3 such that the interrupter member 3 comes to lie on top of the above mentioned support 25 formed in the frame 9.

Turning again to the hammer 1, FIG. 1 illustrates that the hammer 1 includes an abutment 17 co-operating with the hammer stop abutment 12 of the hammer lock member 2. The reference numeral 19 identifies the firing pin striking area of the hammer 1.

The illustrated embodiment includes, furthermore, the as such well-known hammer spring 10 acting onto the rod-shaped spring guide 11, which is biassed against the hammer 1 to cause it to strike the firing pin 6 upon its releasing. The firing pin 6 is located according to wellknown designs in the slide 7 of the gun.

The lower side of the hammer 1 includes, furthermore, an oblique bottom resting surface 22. The rod-shaped spring guide includes likewise an oblique top supporting surface 23 onto which the bottom resting surface 22 of the hammer 1 rests in the illustrated state thereof. These two surfaces are illustrated by means of one common dashed line in FIG. 2.

Now, the operating of this embodiment of the invention will be described in detail, whereby it will become obvious that the hammer 1 is secured against an accidental striking or contacting the firing pin 6 up to a complete pulling of the trigger 5 into its (right-hand) terminal position, which is arrived at specifically by means of the hammer lock member 2.

If the gun is loaded (or after each firing), the slide 7 is moved backwards (based on the illustration of FIG. 2) on the frame 9, which backward movement is made when loading the gun anew manually or then is produced by the recoil movement after a shot has been fired. This backward movement of the slide 7 causes the hammer 1 to pivot around its pin 18 against the restoring force of the hammer spring 10. The interrupter member 3 is pivotably mounted via the pin 24 to the hammer 1. Accordingly, the pivoting movement of the hammer 1 causes a backward (to the right-hand side) movement of the interrupter member 3.

The tooth 26 of the interrupter member 3, limiting one side of the recess 15 (see FIG. 4), pulls the trigger rod 4 and accordingly the trigger 5 backwards. Furthermore, the first operating projection 13 of the trigger rod 4 which projects into the recess 14 of the rotatable hammer lock member 2 causes the hammer lock member 2 to make a limited rotary movement around its pin 8.

The next following forward movement of the slide 7 allows to forward one round out of the magazine into the chamber of the gun. Simultaneously, the hammer 1 is decocked and urged due to the action of the hammer spring 10 again forward, ie in the direction to the firing pin 6 or slide 7, respectively. This pivoting decocking movement of the hammer 1 causes the interrupter member 3 to move forward, ie to the left, such that its abutment 27 (FIG. 4) limiting the recess 15 at its other side acts onto the second operating projection 16 of the trigger rod 4, moving the trigger rod together with trigger 5 forwards.

This decocking movement of the hammer 1 causes via the first projection 13 of the trigger rod 4, furthermore, the hammer lock member 2 to rotate clockwise around its pin 8 and into the rotational position as illustrated specifically in FIG. 2. In this position, the hammer stop abutment 12 of the hammer lock member 2 abuts flatly the abutment 17 of the hammer 1 such that its firing pin striking area 19 is kept at a small distance away from the firing pin 6.

The gun is now ready to be fired.

For the firing of the gun the trigger 5 is pulled and accordingly the trigger rod 4 is moved backwards. The second projection 16 at the end of the trigger rod 4 projecting into the recess 15 (FIG. 4) is urged against the abutment 27 backwards. Simultaneously, the first projection 13 of the trigger rod 4 projecting into the recess 14 of the hammer lock member 2 (FIG. 5) comes to rest against the area 28 of the hammer lock member 2, such that the backward movement of the trigger rod 4 causes here an anti-clockwise rotation of the hammer lock member 2.

Shortly before reaching the rearmost position of the trigger 5, the trigger rod 4 contacts via its rearward chamfered control surface area 20 the corresponding chamfered control surface area 21 of the frame 9 (which may be a separate member mounted to the frame) and accordingly guided downwards at its rear end. For the sake of order it must be mentioned that a spring (see FIG. 1) acting between the trigger 5 and the trigger rod 4 urges the trigger rod 4 upwards, ie into the recesses 14 and 15 of the hammer lock member 2 and interrupter member 3, respectively.

Due to this lateral downward movement of the rear end of the trigger rod 4, its second projection 16 moves out of the recess 15 of the interrupter member 3 such that it clears the interrupter member 3 completely.

At the same time, the hammer lock member 2 has been rotated anti-clockwise such that its hammer stop abutment 12 has left the position illustrated in FIG. 2, it has moved upwards and along a circular path away from the illustrated position. (The hammer 1 is standing now oblique, it is cocked.) The longer operation projection 13 of the trigger rod 4 remains, however, located inside the recess 14 of the hammer lock member 2, such that it is definitely held in this upturned rotary position.

As soon as the projection 16 has cleared the recess 15 of the interrupter member 3 and accordingly due to the force of the hammer spring 10, the hammer 1 is snapped into its firing pin striking state because now it is not prevented from striking the firing pin 6 by the hammer stop abutment 12 of the hammer lock member 2.

After the shot has been fired, the same slide 7 initiated movements of all members as initially explained reoccur.

The hammer 1 begins its firing movement in a snapwise fashion. In order now to be guided back into its rest position as illustrated in FIG. 2, the hammer 1 is equipped at its bottom end with an oblique bottom resting surface 22. The rod-shaped spring guide 11 has a similarly obliquely extending top supporting surface 23. The rodshaped spring guide 11, still being urged by the hammer spring 10 against the hammer, causes now the mentioned two surfaces 22 and 23 to flatly abut each other in a surface contact, thus guiding the hammer 1 into the illustrated position where its firing pin striking area 19 is at a distance from the firing pin 6.

While there is shown and described a present preferred embodiment of the invention, it is to be distinctly understood that the invention is not limited thereto, but may be otherwise variously embodied and practiced within the scope of the following claims. Specific details of the invention may thus be used elsewhere, eg in revolvers.

I claim:

1. In a double action pistol including a slide, a frame, a firing pin, a hammer, a trigger rod and a trigger pivotably mounted thereto, and hammer decocking and locking means, the improvement wherein:

said hammer decocking and locking means comprises a rotatably mounted hammer lock member having a hammer stop abutment, said hammer lock member being rotatable between a hammer locking and a hammer release position, and said trigger rod having a first operating projection received in a recess of said hammer lock member;

an interrupter member is pivotable mounted to said hammer and has a recess in which a second operating projection of said trigger rod is received, whereby a trigger-caused translatory movement of said trigger rod is transformed into a rotary movement of said hammer lock member and simultaneously transmitted by said interrupter member to said hammer in a way to be transformed into a pivoting movement thereof;

said trigger rod comprises at an end having said first and second operating projections a chamfered control surface area; and said frame comprises a further chamfered control surface area that is aligned with said first named control area, whereby upon pulling said trigger to cock the hammer, cause said translatory movement of said trigger rod and produce a rotation of said hammer lock member to rotate its hammer stop abutment away from the abutment of the hammer, the first named control surface area comes to glide on the second named control surface area causing a lateral movement of said second operating projection out of said recess of said interrupter member such that the hammer is free to strike the firing pin.

* * * * *